US005522351A

United States Patent [19]

Hudson

[11] Patent Number: 5,522,351

[45] Date of Patent: Jun. 4, 1996

[54] INTERNAL COMBUSTION ENGINE TEMPERATURE CONTROL SYSTEM

[75] Inventor: Eric B. Hudson, Hilbert, Wis.

[73] Assignee: Brunswick Corporation, Lake Forest, Ill.

[21] Appl. No.: 445,877

[22] Filed: May 22, 1995

[51] Int. Cl.[6] ..... F01P 11/08

[52] U.S. Cl. ..... 123/41.33; 123/41.42

[58] Field of Search ..... 123/41.33, 41.42, 123/196 AB, 196 W, 41.74

[56] References Cited

U.S. PATENT DOCUMENTS

| | | | |
|---|---|---|---|
| 2,152,594 | 3/1939 | Klotsch | 123/41.74 |
| 4,541,368 | 9/1985 | Costarede | 123/196 AB |
| 4,926,800 | 5/1990 | Valev | 123/41.42 |
| 5,190,003 | 3/1993 | Voigt | 123/41.42 |

FOREIGN PATENT DOCUMENTS

| | | | |
|---|---|---|---|
| 2913649 | 10/1980 | Germany | 123/41.33 |
| 60-43118 | 3/1985 | Japan | 123/41.33 |

*Primary Examiner*—Noah P. Kamen

*Attorney, Agent, or Firm*—Wood, Phillips, VanSanten, Clark & Mortimer

[57] ABSTRACT

The invention is a liquid to liquid heat exchanger incorporated into the body of an internal combustion engine. A first cooling liquid, e.g., oil, is circulated through passages in the engine block and along one side of a heat conducting wall integral the engine block. A second cooling liquid, e.g., water, is circulated through a cooling water passage adjacent to the heat conducting wall to remove heat from the first cooling liquid; and may also be pumped through other passages within the engine block for cooling purposes.

12 Claims, 4 Drawing Sheets

INTERNAL COMBUSTION ENGINE TEMPERATURE CONTROL SYSTEM

FIELD OF THE INVENTION

This invention is in the field of liquid cooled internal combustion engines, relates particularly to liquid to liquid cooling systems for such engines and more particularly to a system for using circulating lubricating oil and water to cool the engine.

BACKGROUND OF THE INVENTION

Liquid cooled internal combustion (IC) engines are typically cooled by circulating the cooling liquid, usually water, through water passages in the engine block adjacent to the cylinder and combustion chamber walls of the engine. The water may be cooled by a radiator, or in the case of marine engines, the water is drawn from a lake or sea and discharged overboard.

Internal combustion engines convert, at best, only about one third of the heat energy, released from burning the fuel, into useful power. Another third of the heat leaves the engine with the exhaust gases and the remaining third is absorbed by the mechanical parts of the engine. It is this last third that the engine cooling system must remove from the engine. If most of the heat absorbed by the mechanical parts of the engine is not removed, over heating and engine damage will result. Fluids are generally circulated through engine passages to absorb the heat from the mechanical components. Common fluids used to cool engines are air, water, oil and glycol.

While it is well known that the failure to remove heat from the mechanical components of the engine can result in damage, it is also true that over cooling the engine can be harmful. Piston rings, used to seal the combustion gases within the cylinder and combustion chamber, are not totally effective and some combustion gases leak past the piston rings into the crankcase of the engine. These gases contain water and by-products of combustion that can be quite corrosive to engine parts if allowed to condense in a cold crankcase. Modern engine oils have additives that are reasonably effective at controlling the corrosive effects of normal amounts of "blow-by", as the leakage past the rings is called, but these additives can be overwhelmed if the engine is not soon warmed enough during operation to eliminate most of the condensation of combustion products within the crankcase.

Maintaining the oil temperature of the lubricating oil of the engine near the normal boiling point of water, 212° F., will assure that the engine temperature is high enough to prevent most of the undesirable condensation of water and combustion products within the crankcase and subsequent oil dilution. In normal engine operation, after the engine has warmed up, a crankcase ventilation system or "breather" removes the blow-by bases from the engine in vapor form. Temperatures below about 280° F. will prevent thermal break down of the oil. Thus, a range of oil temperatures from about 190° to 280° F. is most suited to long term engine operation.

Most liquid cooled engines have the cooling liquid contained in a recirculating system which includes a liquid to air heat exchanger or radiator to remove heat from the cooling liquid after it has passed through the engine. A thermostat is usually placed in the recirculating cooling systems to maintain the coolant, and as a result the engine, at a suitable temperature to prevent blow-by condensation.

Some marine engines, outboard motors in particular, do not utilize radiators or similar heat exchangers in the cooling system. These engines rely, for cooling, upon water drawn from the lake or sea in which they operate.

When lake or sea water is used to cool an engine, an important limitation is that the temperature of the cooling water not be allowed to exceed 140° F. if minerals dissolved in some waters are to be prevented from forming deposits within the cooling passages. This maximum water temperature is relatively low compared to the 180°–190° F. minimums normally maintained in modem sealed recirculating systems employing glycol and water coolant.

The invention addresses the problem of low coolant temperatures encountered in the marine environment by exposing the oil to a large area of the engine through which heat will flow into the oil, particularly during low and partial load operation. A novel liquid to liquid heat exchanger built into the engine extracts some of the heat from the oil but maintains an oil to water temperature difference which allows both oil and cooling water temperatures to remain within the desired ranges during normal operations.

Liquid to liquid heat exchangers have been employed on marine engines in applications to remove excess heat from the oil. These applications are external additions to engines used when the problem of excessive oil temperatures are encountered. An example can be found on the Mercruiser Class 1 Offshore racing engines manufactured by the Mercury Marine Division of Brunswick Corporation. The invention which is the subject of this disclosure differs from past applications in that it is primarily designed to maintain a minimum oil temperature, rather than limit a maximum temperature, and is built or cast into the internal configuration of the engine block rather than being an external accessory.

SUMMARY OF THE INVENTION

The invention is a liquid to liquid cooling system for a reciprocating internal combustion engine, comprising; a liquid to liquid heat exchanger substantially integral to the engine block, a first cooling liquid chamber is defined by a cavity within the cylinder block and a second cooling liquid chamber is positioned at least partially adjacent to the first cooling chamber. A common heat conducting wall divides the first and second cooling chambers. First pump means is provided for circulating a first cooling liquid through selected passages in the engine block and the first cooling chamber and a second pump means is provided for circulating a second fluid cooling liquid through the second cooling chamber, so that heat from the engine parts is transferred to the first cooling liquid and heat from the first cooling liquid is transferred to the second cooling liquid through the common heat conducting wall.

The invention contemplates an oil jacket adjacent to and preferably surrounding the cylinder wall of the engine. A lubricating oil system pumps oil from a storage reservoir to selected bearing surfaces from which it drains into a sump in the crankcase. A scavenging pump takes oil that drains from the engine parts and accumulates in the sump and pumps it through the oil jacket and back to the oil reservoir. A cooling water system for the engine is provided wherein cooling water is pumped through passages in the engine and adjacent to a portion of the outer wall of the oil jacket; so that heat generated within the cylinder flows through the outer wall of the oil jacket and into the cooling water flowing adjacent thereto. Water may also flow through the cylinder head and into the exhaust passage to help cool the engine. During circulation, oil is used as a cooling medium, transferring heat from the internal mechanical parts to the water jacket in a manner that maintains the oil temperature at a desired level above the water temperature.

In the embodiment of the invention here described, the invention relies mainly upon the extraction of heat from the cylinder liner to add heat to the lubricating oil. Oil is circulated through an oil cooling jacket surrounding the cylinder liner. The second cooling jacket, containing a flow of cooling water, partially surrounds the oil cooling jacket. This water jacket is used to moderate the temperature of the oil in the oil cooling jacket. The cylinder head and exhaust passages are cooled directly by water that has passed through the water jacket, which is then directed out through the exhaust passage. The exhaust passage may also be cooled by a portion of the oil jacket lying adjacent thereto.

In a preferred embodiment of the invention, oil is directed into the oil jacket below or near the bottom of the cylinder liner and exits above or near the top of the cylinder liner so that air entrained in the scavenged oil does not create air pockets, and resulting hot spots, within the oil jacket. In addition to bottom to top flow, circulation normal to the bottom to top direction is encouraged for more uniform temperature within the cylinder liner.

In a preferred embodiment of the invention, removable cylinder liners of a piston engine are mounted within a cavity within the cylinder block that is large enough so that a space remains around the cylinder liners which form a passage, or oil jacket, for oil flow around the cylinder liners. This configuration has attendant advantages when an iron cylinder liner is used with an aluminum block in that no water comes into contact with the iron liner, thus preventing corrosion of the liner.

In one preferred embodiment of the invention the engine block casting includes a reservoir for the lubricating oil. Passages for the oil from the oil reservoir to the oil circulating pump, from the oil circulating pump to the bearings, from the oil sump to the oil scavenging pump and from the scavenging pump to the oil jacket are all comprised of one or more intersecting bores cast or drilled within the engine block and crankcase cover.

In another contemplated embodiment of the invention the oil jacket around the cylinder liner is enlarged to serve as the oil reservoir in addition to having the heat exchanger area. The oil flow in this version varies from the previous description in that the scavenged oil from the sump is directed into the upper portion of the reservoir and allowed to pour over the cylinder liner, cooling it. An oil supply pump draws oil from below the cylinder liner.

DETAILED DESCRIPTION OF THE PREFERRED EMBODIMENT OF THE INVENTION

Figure 1:
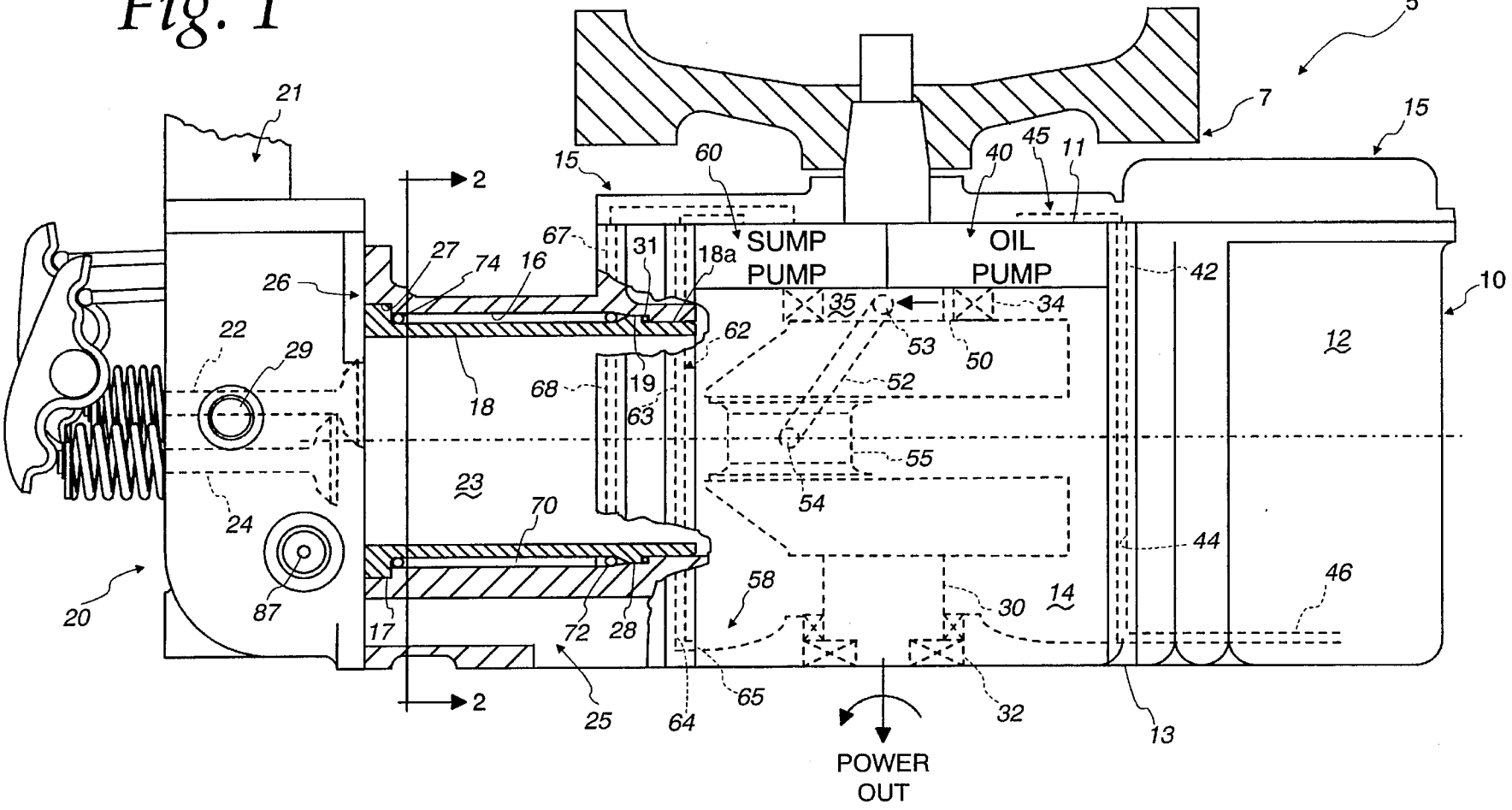
FIG. 1 is a side elevational view, partially schematic, of an IC engine embodying the invention cut away in the area of the cylinder to show an oil jacket and exhaust passage of the engine.
Figure 3:
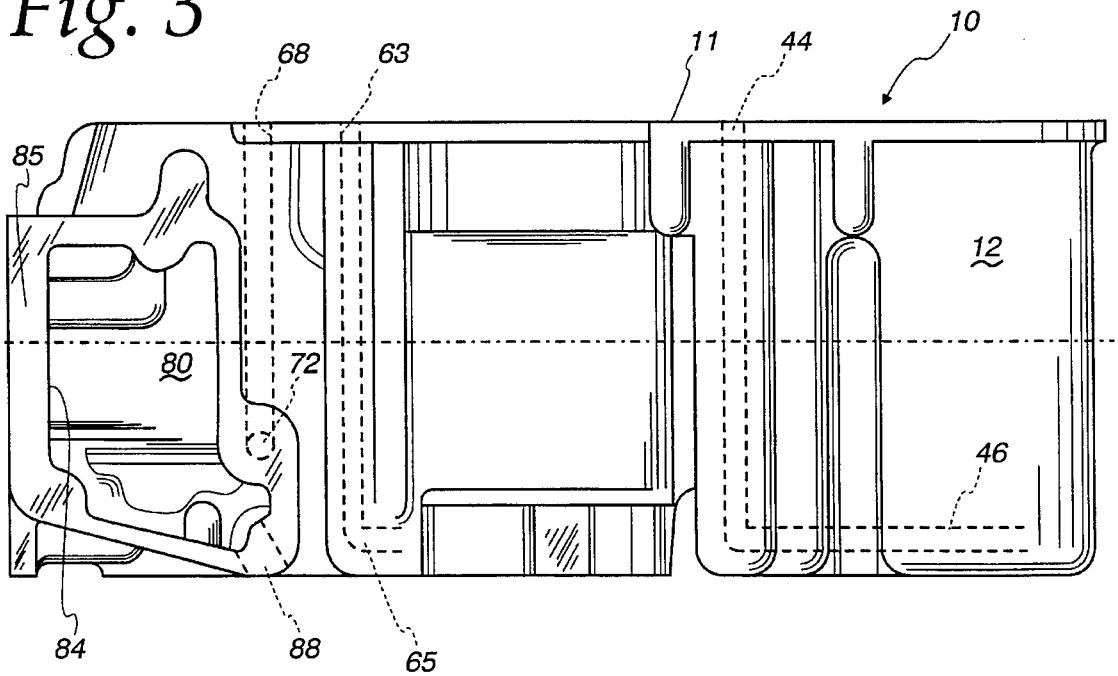
FIG. 3 is a side elevational view of the cylinder block for the engine of FIG. 1 showing the water jacket for the cylinder with the water jacket cover removed
Figure 4:
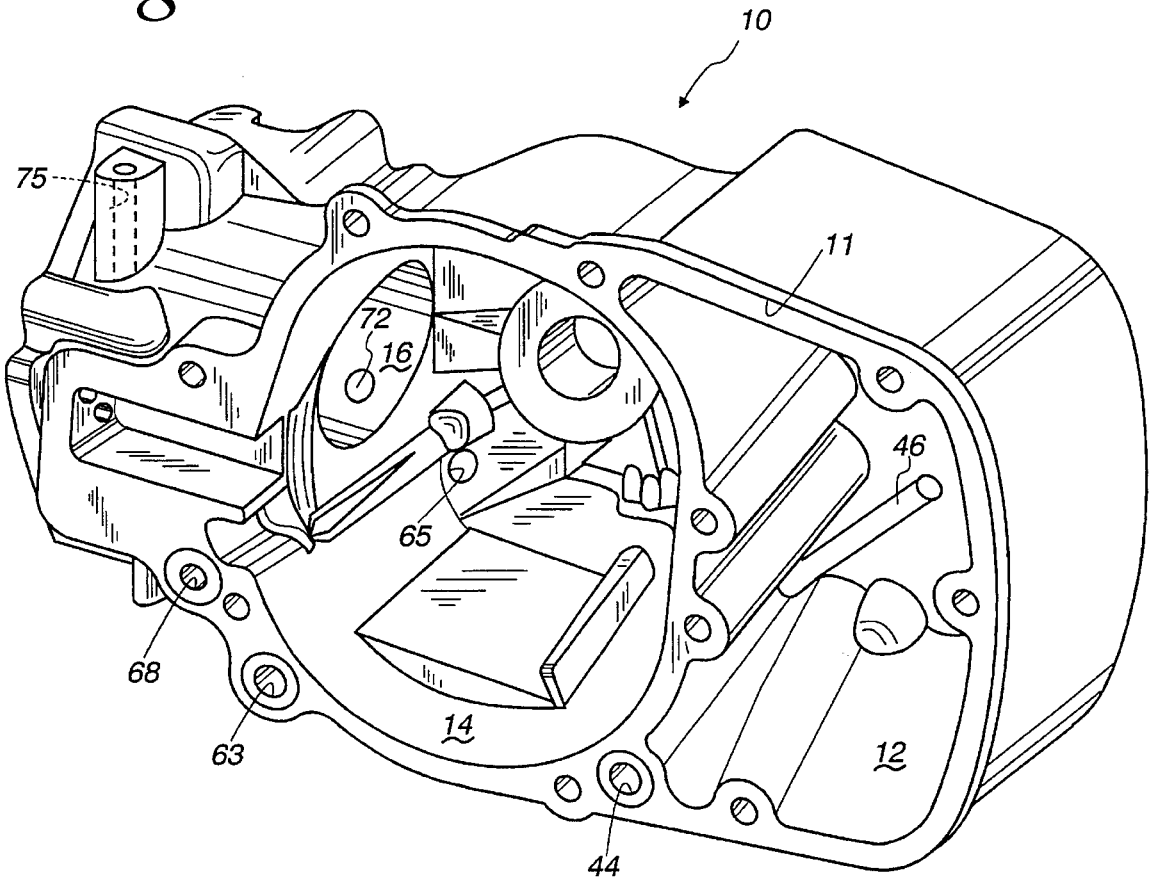
FIG. 4 is a perspective view of the cylinder block of the engine of FIG. 1, with the cylinder liner removed.

Referring to FIGS. 1, 3, and 4, the invention is embodied in a single cylinder piston driven engine 5 having a block 10 cast of aluminum which incorporates an oil reservoir 12, the crank case cavity 14 and a cylinder bore 16 within which is fitted a cylinder liner 18. The crank case cavity 14 and the reservoir are closed by a cover 15 bolted to the top 11 of the block 10. A cylinder head 20 which supports an intake valve 22 and exhaust valve 24 for the cylinder 23 is mounted on the cylinder end 26 of the block 10. The crank shaft 30 for the engine 5 is supported within the crank case 14 by a lower bearing 32 and an upper bearing 34 in the manner typical of the art. A flywheel 7 is attached to the top of the crank shaft 30. An oil circulating pump 40, illustrated schematically, has an intake oil line 42 comprised of a vertical bore 44 extending from the top 11 of the block 10 to a point near the bottom 13 of the block 10 and a horizontal bore 46 which extends into the oil reservoir 12. The vertical bore 44 is located to one side of the engine block 10 and the horizontal bore 46, or a tubular extension thereof (see FIG. 4), extends to the opposite side of the reservoir 12 to prevent oil from flowing through the line 42 when the engine is laid on either side. Oil coming up the vertical bore 44 in the block 10 proceeds through a passage 45, shown schematically in the cover 15 of the engine 5 to the inlet of the oil pump 40.

In operation the oil circulating pump 40 draws oil from the reservoir 12 and pumps it into the bearing 34. An oil groove 50 extends around the inner surface of the upper crank shaft bearing 34. As the crank shaft 30 rotates, oil from the oil groove 50 enters an internal oil passage 52 extending from the upper main bearing surface 35 of the crank shaft 30 to the surface of the crank pin 55, where the oil feeds the journal bearing of the connecting rod (not shown) for the cylinder of the engine in a manner typical of the IC engine art. Thus, oil enters the passage 52 at the upper end 53 and exits at the lower end 54 to lubricate the connecting rod bearing. Oil exiting at 54 is thrown throughout the interior of the crank case 14 by rapid rotation of the crank shaft 30 and so lubricates the remaining internal components of the engine. Oil so supplied to the crank case bearings drains by gravity to the sump area 58 of the crank case 14. Oil is withdrawn from the sump 58 by the action of the scavenging pump 60 through an oil intake line 62. Intake line 62 is comprised of vertical and horizontal bores 63 and 64, respectively, in the block 10 which connect the intake of the scavenging pump 60 to an oil intake port 65 located in the sump area 58 of the crank case 14. The scavenging pump 60 functions to force oil drawn from the sump 58 through an oil jacket 70 between the cylinder liner 18 and the wall of the bore 16 in the block 10 and back to the oil reservoir 12, in the following manner. Oil exits the scavenging pump 60 through an oil line 67 which comprises a vertical bore 68 in the block 10. The vertical bore 68 intersects a horizontal bore 69 (best seen in FIG. 2) in the block 10. Bore 69 penetrates the bore 16 and provides an opening 72 for the oil in line 67 from the scavenging pump 60 to enter the cylindrical area between the cylinder liner 18 and the bore 16 which forms the oil jacket 70. As the oil is under pressure from the scavenging pump 60 it fills the jacket 70. The oil entry 72 is positioned near the end of the oil jacket 70 nearest the crank shaft 30.

Figure 2:
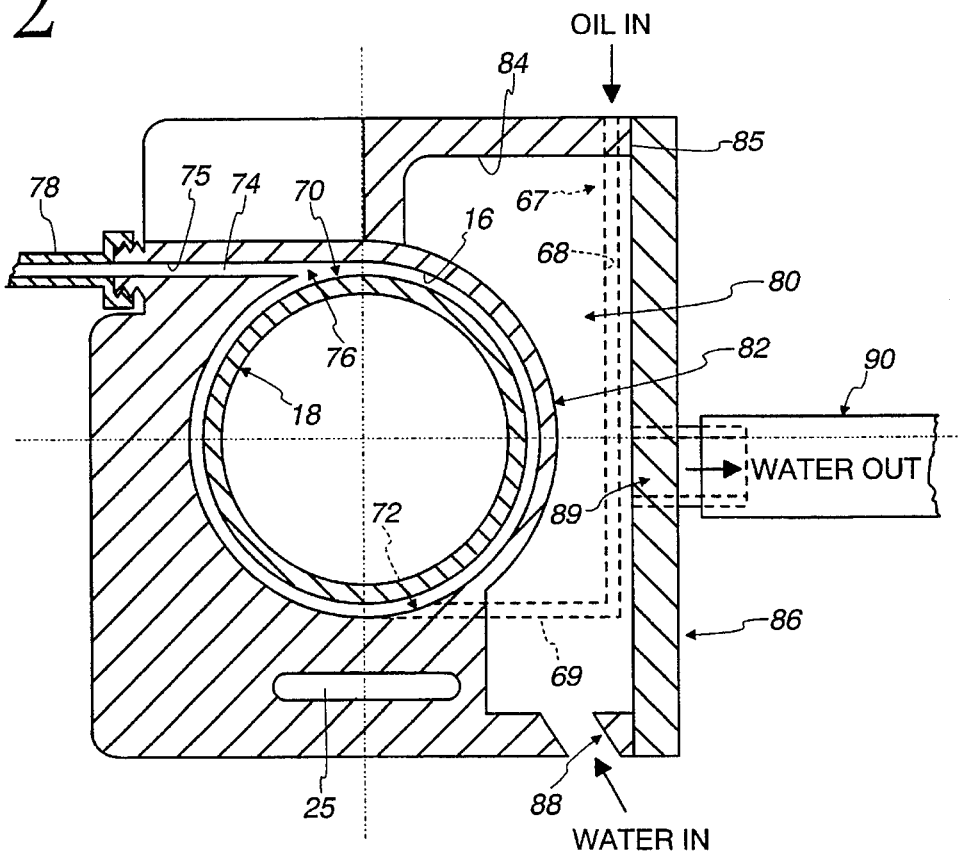
FIG. 2 is a cross-sectional view taken along line 2—2 of FIG. 1.

Referring to FIG. 2, oil exits the oil jacket 70 through a horizontal line 74 comprised of a bore 75 in the block 10 which penetrates the oil jacket 70 at a point 76. The bore 75 exits the block 10 and connects to an exterior oil line 78 through which the oil leaving the oil jacket 70 is returned to the oil reservoir 12.

Oil pumps 40 and 60 and their inlet passages 45 and 62 (respectively) and the outlet passage 67 of pump 60 in the crank case cover 15 and block 10 are shown schematically, as the pumps may be any suitable type known in the art and are not part of this invention. However, gear pumps suitable for this particular application are described in Ser. No. 08/472,892, filed in the name of Eric B. Hudson, the inventor of this invention, and assigned to the assignee of this application. For purpose of this disclosure, that portion of the aforementioned patent application pertaining to the oil pumps and their inlet and outlet passages in the cover 15 is incorporated herein by reference.

Figure 5:
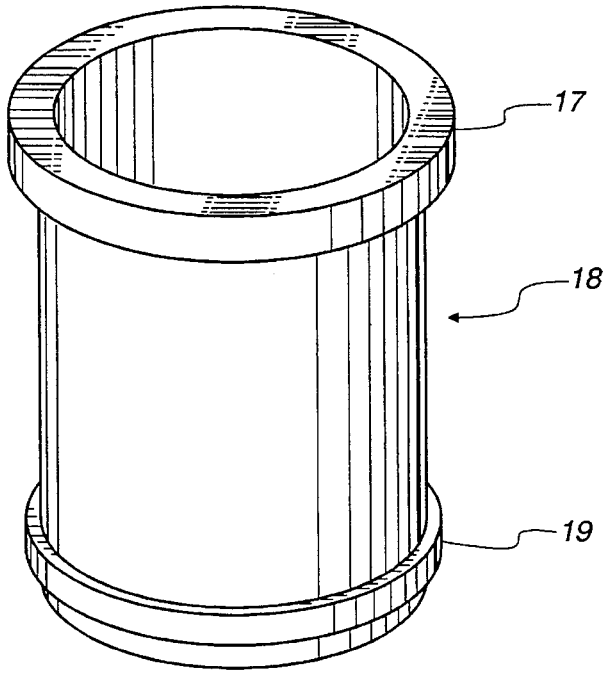
FIG. 5 is a perspective view of a cylinder liner for the engine of FIGS. 1–4.

FIGS. 1 and 5 illustrate the cylinder liner 18 which is generally cylindrical in shape with a flange 17 on the end thereof closest to the cylinder head 20 and a flange 19 on the end nearest the crank case 14. The flange 19 is smaller in diameter than the main body of the bore 16. When the liner 18 is inserted into the bore 16, the flange 19 slides easily through the bore 16. The flange 17 is received in a counter bore 27 cut into the outer periphery of the cylinder bore where it intersects the end face 26 of the block 10. The end 18*a* of the liner 18 opposite flange 17 is engaged by an counter bore 28 in the bore 16 near the crank case 14 which is smaller in diameter than the main body of the bore 16. An "O"-ring seal 31 between the liner 18 and the bore 16 is trapped between the flange 19 and the counter bore 28. Axial force on the flange 17 generated when the cylinder head 20 is fastened to the block 10 seals the flange 17 against the surface of the counter bore 27.

Referring to FIG. 1, the fuel and air mixture for the engine enters the cylinder 23 through an air intake 21 and an internal passage (not shown) through the head 20 and the intake valve 22. Exhaust exits the cylinder 23 through the exhaust valve 24, an internal passage (not shown) in the head 20, and an exhaust passage 25 in the bottom of the block 10. If the engine is used in an outboard motor, the exhaust passage 25 may connect to a mating exhaust passage in the drive shaft housing of the motor.

As best seen in FIG. 2, the block 10 and the oil passing through the oil jacket 70 are all cooled by water passing through a water jacket 80 positioned on one side of the block 10. The water jacket 80 is cast into the block 10 such that a relatively thin wall 82 separates the oil jacket 70 from the water jacket 80. FIG. 3 shows the shape and location of the water jacket 80 on the block 10. The jacket 80 is enclosed by a wall 84 which extends outwardly of the block 10 and a removable cover 86 which is sealed and bolted to the top 85 of the wall 84.

Cooling water supplied by a water pump (not shown) enters the water jacket 80 through an entry passage 88 cast in the surface 13 of the block 10 and exits through a passage 89 through the cover 86 of the water jacket 80. The passage 89 is connected by an external hose 90 to a cooling water inlet 29 in the cylinder head 20 (see FIG. 6).

Figure 6:
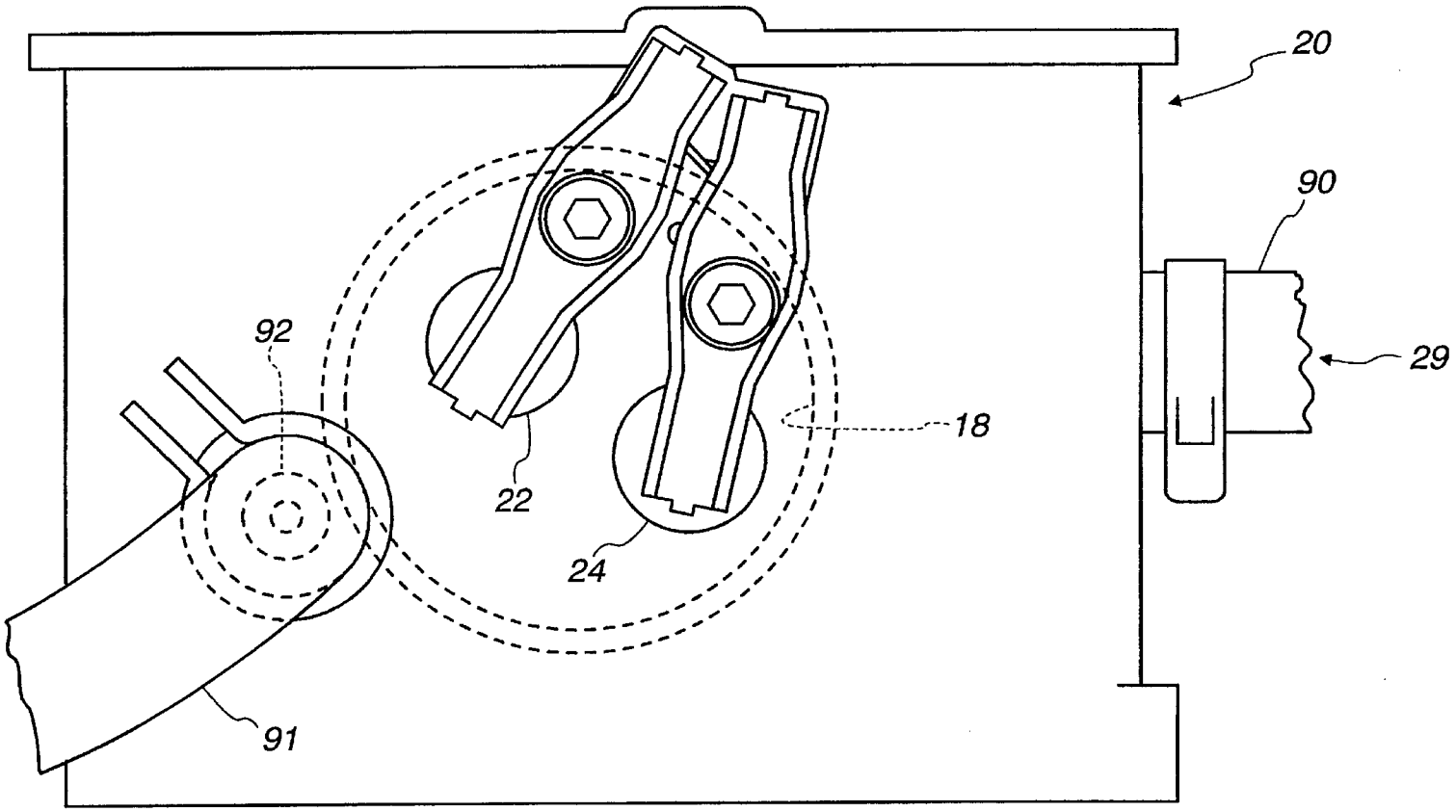
FIG. 6 is a simplified top view of a cylinder head for the engine of FIG. 1.

Referring to FIGS. 2 and 6, cooling water leaves the cooling water jacket 80 through the passage 89 and flows through the hose 90 to the water inlet 29 in the side of the head 20. The cooling water flows through passages in the head 20 in a manner typical of the art and exits through a thermostatic control valve 92 which controls the temperature of the water exiting the head and maintains it at the desired temperature.

When the engine is used as an outboard motor, the cooling water exits the head 20 into an external water line 91 which reenters the block 10 on the side opposite the water jacket 80 and typically flows out through the drive shaft housing of the outboard motor with the engine exhaust. Water will also exit the cylinder head 20 through a small opening 87 in the head 20 (see FIG. 1) to provide a small stream of water or "tell-tale" to provide visual confirmation that the water is flowing through the cooling system.

FIGS. 3 and 4 illustrate the engine block 10 with the top crank case cover 15 and the cylinder head 20 removed. These figures illustrate where the vertical oil passage o bores 44, 63 and 68 are positioned in the block 10, the position of the oil intake line 46 within the oil reservoir 12 and the scavenging pump intake 65 in the bottom of the crank case 14. Points for drill entry through the block 10 to make the horizontal bores 46, 64 and 69 will, of course, have to be sealed.

In operation, heat from the combustion gases flows through the metal wall of the cylinder liner 18 into the oil circulating in a jacket 70 surrounding the cylinder liner 18. Some of this heat then flows through the metal wall 82 separating the oil cooling jacket 70 from the water jacket 80. It is this wall 82 which serves as an internal liquid to liquid heat exchanger. The engine speed and load determine the amount of heat that can flow into the oil from the cylinder liner 18. The flow of water, the area of the water jacket 80, and the difference in water and oil temperatures determine the rate of heat flow from the oil to the cooling water. Cooling water that has passed through the liquid to liquid heat exchanger can then be used to cool the cylinder head 20 and exhaust passage 25. A thermostat 92 placed in the cooling water line 91 controls the cooling water temperature.

Experimental work has shown that it is possible to attain workable heat transfer between the oil and water while keeping the temperatures of each within desired levels. At a peak water flow of 10 gallons per horse power hour, with inlet temperatures normally found in navigable waters, a heat transfer area, e.g., wall 82, in the oil to water heat exchanger of 0.8 square inches per horse power has proven to be a good design starting point when the heat is exchanged through a one-eighth inch wall of aluminum.

It will be understood that although the embodiments described arrange the liquid to liquid heat exchanger for oil and water directly adjacent to the cylinder, other locations within the cylinder block or reservoir are possible.

The foregoing disclosure of specific embodiments is intended to be illustrative of the broad concepts comprehended by the invention. Other aspects, objectives and advantages of this invention can be obtained from a study of the drawings, the disclosure and the appended claims.

I claim:

1. In a liquid cooled internal combustion engine having a cylinder block with at least one cylinder having a cylinder wall, a cylinder head, a drive train, a crank case comprising an oil sump, and an oil lubricating system for the drive train, an improvement comprising:

a first cavity in the cylinder block surrounding the cylinder wall, a second cavity adjacent to and outside the first cavity and apart from the cylinder wall, and a heat conducting wall separating the first and second cavities so that the said cavities comprise a heat exchanger;

means for pumping oil through the first cavity;

a cooling water passage through the cylinder head;

conduit means connecting the second cavity and the cooling water passage; and means for pumping cooling water through the second cavity, the conduit means and the cooling water passage, whereby oil in the first cavity cools the cylinder wall and water in the second cavity cools the oil in the first cavity and then the cylinder head.

2. The internal combustion engine of claim 1 wherein the oil lubricating system comprises an oil reservoir separate from the oil sump and means for pumping oil from the reservoir through the lubricating system and wherein the lubricating oil drains into the sump of the crank case.

3. The internal combustion engine of claim 2 wherein the means for pumping oil through the first cavity comprises an oil intake in the sump.

4. The internal combustion engine of claim 3 wherein the first cavity comprises the oil reservoir.

5. In a reciprocating internal combustion engine having a cylinder head, a cylinder block with at least one cylinder having a cylinder wall, a crank case, a drive train within the crank case, a pressurized oil lubricating system for the drive train, an oil sump into which the lubricating oil drains from the drive train, and a cooling water system, an improvement comprising:

an oil reservoir separate and apart from the oil sump;

an oil jacket having inner and outer heat conducting walls, the inner wall comprising the cylinder wall;

means for pumping oil from the oil reservoir through the lubricating oil system;

means for pumping oil from the sump through the oil jacket into the oil reservoir; and a cooling water jacket adjacent to the oil jacket having an inner and outer wall, the heat conducting outer wall of the oil jacket comprising the inner wall of the water jacket, said cooling water jacket being apart from the cylinder, so that the cylinder wall is cooled by oil from the sump.

6. The internal combustion engine of claim 5 further comprising a cooling water passage in the head of the engine and conduit means for conducting water from the water jacket to the cooling water passage in the head, wherein the cooling water system comprises a pump for forcing cooling water through the cooling water jacket and subsequently through the cooling water passage in the head of the engine.

7. The internal combustion engine of claim 6 wherein the lubricating oil system comprises an oil intake line for the oil pump comprised of a first section extending substantially vertically of the engine and positioned on one side of the engine, and a second section extending substantially horizontally of the engine into the oil reservoir and laterally to a position within the reservoir adjacent the other side of the engine, so that oil will not flow from the reservoir through the line by gravity when the engine is laid on either side.

8. A single cylinder four cycle internal combustion outboard motor wherein the engine block comprises a unitary casting comprising means for supporting a cylinder liner, a crank case with an oil sump, an oil reservoir separate from the crank case and sump, an oil chamber surrounding the cylinder liner, said oil chamber having an outer wall, an oil inlet line to the oil chamber and an oil outlet line from the oil chamber, said inlet and outlet lines extending through the outer wall of the chamber, a water chamber adjacent to the oil chamber, the outer wall of the oil chamber comprising the inner wall of the water chamber, and wherein a portion of said water chamber is opened to the exterior of the block.

9. The improvement of claim 8 wherein the water chamber is comprised in part of means separate from the cylinder block for enclosing the water chamber and means for attaching the enclosing means to the engine block.

10. A method of cooling a four cycle internal combustion outboard motor having a cylinder block and head, a lubricating oil system, an oil sump in the block, an oil reservoir separate from the sump, and a water cooling system utilizing water from the body of water in which the motor is operating, comprising the steps of:

pumping the lubricating oil from the oil reservoir through the lubricating oil system of the engine;

draining the oil into the oil sump;

providing a cooling oil chamber around the cylinder wall;

pumping oil from the sump through the cooling oil chamber to the oil reservoir;

providing a cooling water chamber adjacent to and outside the cooling oil chamber so that said oil and water cooling chambers comprise a heat exchanger;

providing a cooling water passage through the head of the motor; and pumping cooling water from the body of water in which the motor is operating first through the cooling water chamber and second through the cooling water passage in the head.

11. In an internal combustion engine comprising an engine block having an oil sump, a cylinder defined by a cylindrical wall, a drive train comprised of a crank shaft and a plurality of journals supporting the crank shaft in the block, a cooling water system having a water pump and a lubricating oil system having an oil pump for supplying oil to the drive train from which the oil drains into the oil sump;

an improved means for storing lubricating oil for the engine comprising:

an oil jacket defined in part by and surrounding the cylinder wall, said oil jacket comprising a reservoir for the lubricating oil having an oil inlet and an oil outlet;

an oil line connecting the intake of the oil pump to the outlet of the oil jacket; and scavenging pump means for pumping lubricating oil from the sump to the oil inlet in the oil jacket reservoir.

12. The improvement of claim 11 wherein the cylinder is horizontal, the oil inlet to the oil jacket is substantially above the cylinder wall;

the oil jacket outlet is substantially below the oil jacket inlet, and wherein said inlet comprises means for directing incoming oil over the cylinder wall so that the cylinder wall is cooled by the oil flow.

* * * * *